US010589405B2

(12) United States Patent
Wang

(10) Patent No.: US 10,589,405 B2
(45) Date of Patent: Mar. 17, 2020

(54) SPEED INCREASING BIDIRECTIONAL MECHANICAL CONVERTER

(71) Applicants: Hangzhou Great Star Tools Co., Ltd., Hangzhou (CN); Hangzhou Great Star Industrial Co., Ltd., Hangzhou (CN)

(72) Inventor: Min Wang, Hangzhou (CN)

(73) Assignees: Hangzhou Great Star Tools Co., Ltd., Hangzhou (CN); Hangzhou Great Star Industrial Col., Ltd., Hangzhou (CN); Ratchet Solutions, Inc., Auburn, WA (US)

( * ) Notice: Subject to any disclaimer, the term of this patent is extended or adjusted under 35 U.S.C. 154(b) by 360 days.

(21) Appl. No.: 15/325,611

(22) PCT Filed: Jul. 11, 2014

(86) PCT No.: PCT/CN2014/082057

§ 371 (c)(1),
(2) Date: Jan. 11, 2017

(87) PCT Pub. No.: WO2016/004624

PCT Pub. Date: Jan. 14, 2016

(65) Prior Publication Data

US 2017/0165815 A1 Jun. 15, 2017

(51) Int. Cl.
*B25B 15/04* (2006.01)
*B25B 17/00* (2006.01)
(Continued)

(52) U.S. Cl.
CPC ..... *B25B 15/04* (2013.01); *B25B 15/02* (2013.01); *B25B 17/00* (2013.01); *B25B 17/02* (2013.01); *B25B 13/467* (2013.01)

(58) Field of Classification Search
CPC ..... B25B 17/00; B25B 17/02; B25B 15/00; B25B 15/02; B25B 15/04
See application file for complete search history.

(56) References Cited

U.S. PATENT DOCUMENTS 5,333,517 A 8/1994 Bryson et al.
9,833,883 B2 * 12/2017 Wang ..... B25B 17/00
(Continued)

FOREIGN PATENT DOCUMENTS

CN 2271642 12/1997
CN 102145477 8/2011
(Continued)

OTHER PUBLICATIONS

International Search Report for International Application PCT/CN2014/082057 dated Feb. 6, 2015.
(Continued)

*Primary Examiner* — Bryan R Muller
(74) *Attorney, Agent, or Firm* — Andrus Intellectual Property Law, LLP

(57) ABSTRACT

A speed increasing bidirectional mechanical converter, including a main shaft and a speed increasing planet gear unit is disclosed. The speed increasing planet gear unit includes a first ring gear, a planet gear, a sun gear and a planet carrier, wherein the planet gear is mounted on the planet carrier. The planet gear is arranged between the first ring gear and the sun gear, and rotates in an opposite direction against the sun gear. The speed increasing bidirectional mechanical converter further includes a reversing means, via which the first ring gear and the sun gear drive the main shaft. When in use, the planet carrier is kept still, and the main shaft rotates in the preset direction. The speed increasing bidirectional mechanical converter realizes the direction reverse by using the speed increasing planet gear unit, which simplifies the structure, facilitates the manufacture and decreases the space it occupies and its weight. A screwdriver and a wrench having the speed increasing bidirectional mechanical converter are provided.

11 Claims, 9 Drawing Sheets

(51) Int. Cl.

| | |
|---|---|
| ***B25B 15/02*** | (2006.01) |
| ***B25B 17/02*** | (2006.01) |
| *B25B 13/46* | (2006.01) |

(56) References Cited

U.S. PATENT DOCUMENTS

| | | | | |
|---|---|---|---|---|
| 10,022,846 | B2 * | 7/2018 | Wang | B25B 15/04 |
| 2010/0018366 | A1 | 1/2010 | Hu | |
| 2014/0053695 | A1 | 2/2014 | Gauthier et al. | |

FOREIGN PATENT DOCUMENTS

| | | | | | |
|---|---|---|---|---|---|
| CN | 102145477 | A | * | 8/2011 | B25B 13/46 |
| CN | 203245777 | | | 10/2013 | |
| CN | 103753465 | A | | 4/2014 | |
| CN | 203680184 | | | 7/2014 | |
| CN | 203696882 | U | | 7/2014 | |
| CN | 104097172 | A | | 10/2014 | |
| CN | 204277894 | A | | 4/2015 | |
| DE | 3325534 | A1 | | 1/1984 | |
| DE | 102005023866 | B4 | | 11/2006 | |
| EP | 2130647 | A3 | | 12/2009 | |
| JP | 47-039559 | B | * | 5/1972 | |
| JP | S47-39559 | | | 10/1972 | |
| JP | S58-5152 | | | 1/1983 | |
| JP | 3146715 | U | | 11/2008 | |
| JP | 2008290206 | A | | 12/2008 | |
| WO | 2007075926 | A2 | | 7/2007 | |

OTHER PUBLICATIONS

Written Opinion for International Application No. PCT/CN2014/082057 dated Feb. 6, 2015.

* cited by examiner

SPEED INCREASING BIDIRECTIONAL MECHANICAL CONVERTER

CROSS-REFERENCE TO RELATED APPLICATIONS

This application claims priority to PCT/CN2014/082057, filed Jul. 11, 2014, and published in Chinese on Jan. 14, 2016 as publication number WO 2016/004624 A1.

FIELD OF THE INVENTION

The present invention relates to a manual tool, more particularly, to a manual speed increasing bidirectional turning tool.

DESCRIPTION OF THE PRIOR ART

A manual turning tool is used for turning a workpiece and forcing it to be in position. It usually includes screwdriver, wrench and so on.

To increase the efficiency, prior screwdriver or wrench is equipped with a mechanical converter, which includes a main shaft and two driving parts. The two driving parts rotate in an opposite direction and drive the main shaft via one-way clutches whose functioning directions are the same. When a torque is applied to the driving parts, one of the two driving part drives the main shaft to rotate and the other idles. The main shaft rotates in one direction no matter the input torque is clockwise or anticlockwise. Thus input torque in any direction can be utilized and the efficiency of the tool is highly increased.

To further increase the efficiency, some screwdriver or wrench is equipped with speed increasing means, which generally is planet gear unit.

In prior screwdriver or wrench, the direction switching and the speed increasing functions are achieved by different parts. The structure is comparatively complicated, the manufacture is comparatively complex, and the space occupied and the weigh are comparatively large.

SUMMARY OF THE INVENTION

The present invention provides a speed increasing bidirectional mechanical converter, wherein the direction switching is achieved by a speed increasing planet gear unit, which simplifies the structure of the speed increasing bidirectional mechanical converter, facilitates the manufacture and meanwhile decreases the space occupied inside the tool and the weight.

The present invention further provides a screwdriver including the speed increasing bidirectional mechanical converter. Keeping the holding ring of the screwdriver still, when the handle rotates in a preset direction, the bit of the screwdriver rotates in the preset direction at the same speed; when the handle rotates in a direction opposite to the preset direction, the bit of the screwdriver rotates in the preset direction at triple the speed.

The present invention further provides a wrench including the speed increasing bidirectional mechanical converter. Keeping the holding ring of the wrench still, when the handle rotates in a preset direction, the torque outputting part of the wrench rotates in the preset direction at the same speed; when the handle rotates in a direction opposite to the preset direction, the torque outputting part of the wrench rotates in the preset direction at triple the speed.

The present invention provides a speed increasing bidirectional mechanical converter, comprising a main shaft, a speed increasing planet gear unit, which includes a first ring gear, a planet gear, a sun gear and a planet carrier, wherein the planet gear is mounted on the planet carrier, the planet gear is arranged between the first ring gear and the sun gear, and the first ring gear rotates in an opposite direction against the sun gear;

the speed increasing bidirectional mechanical converter further includes a reversing means, via which the first ring gear and the sun gear drive the main shaft;

when in use, the planet carrier is kept still, and the main shaft rotates in a preset direction no matter a clockwise or anticlockwise torque is applied to the first ring gear.

The speed increasing bidirectional mechanical converter provided in the present invention utilizes the technical feature that in the speed increasing planet gear unit the first ring gear and the sun gear rotates in opposite directions, and makes the first ring gear and the sun gear to drive the main shaft respectively via the reversing means, thereby realizes the reverse of the directions. The main shaft rotates in a preset direction no matter a clockwise or anticlockwise torque is applied to the first ring gear.

The speed increasing bidirectional mechanical converter provided in the present invention has simple structure and is easy to manufacture, and the space it occupies and its weight in the tool are decreased as well.

Further, the reversing means includes a first one-way clutch and a second one-way clutch with same functioning directions which are same with the preset direction.

The speed increasing bidirectional mechanical converter provided in the present invention makes the first ring gear and the sun gear to drive the main shaft respectively via the one-way clutches with same functioning directions, and thereby realizes the reverse of the directions.

Further, the speed increasing bidirectional mechanical converter further includes a second ring gear which is coaxially arranged with the first ring gear and connected to the first one-way clutch.

Further, the first ring gear and the second ring gear are integrated or coaxially connected.

Further, the speed increasing bidirectional mechanical converter further includes a third ring gear which is coaxially arranged with the sun gear and connected to the second one-way clutch.

Further, the sun gear and the third ring gear are integrated or coaxially connected.

Further, the speed increasing bidirectional mechanical converter further includes a switching means, which is used for switching the functioning directions of the first one-way clutch and the second one-way clutch.

Further, the speed increasing bidirectional mechanical converter further includes a holding means, which is used for keeping the planet carrier still.

Further, the holding means and the planet carrier are integrated or fixedly connected.

Further, the holding means is a holding ring.

Further, the main shaft rotates in the preset direction at an increased speed when a torque whose direction is opposite to the preset direction is applied to the first ring gear.

Further, the transmission ratio of the rotation of the main shaft in the preset direction at an increased speed is equal to the gear ratio between the first ring gear and the planet gear.

Further, the transmission ratio of the rotation of the main shaft in the preset direction at an increased speed is 3.

Further, the main shaft rotates in the preset direction at a same speed when a torque whose direction is same with the preset direction is applied to the first ring gear.

Further, the transmission ratio of the rotation of the main shaft in the preset direction at a same speed is 1.

The present invention further provides a screwdriver, including a rod, a speed increasing bidirectional mechanical converter, comprising a main shaft, which is coaxially arranged with the rod;

a speed increasing planet gear unit, which includes a first ring gear, a planet gear, a sun gear and a planet carrier, wherein the planet gear is mounted on the planet carrier, the planet gear is arranged between the first ring gear and the sun gear, and the first ring gear rotates in an opposite direction against the sun gear;

a handle, which is coaxially arranged with the first ring gear and used for inputting torque;

the speed increasing bidirectional mechanical converter further includes a reversing means, via which the first ring gear and the sun gear drive the main shaft;

when in use, the planet carrier is kept still, and the rod rotates in a preset direction no matter a clockwise or anticlockwise torque is applied to the first ring gear by the handle.

Further, the reversing means includes a first one-way clutch and a second one-way clutch whose functioning directions are same as the preset direction.

Further, the speed increasing bidirectional mechanical converter further includes second ring gear which is coaxially arranged with the first ring gear and connected to the first one-way clutch.

Further, the first ring gear and the second ring gear are one-piece or connected coaxially.

Further, the speed increasing bidirectional mechanical converter further includes a third ring gear which is coaxially arranged with the sun gear and connected to the second one-way clutch.

Further, the sun gear and the third ring gear are integrated or coaxially connected.

Further, the speed increasing bidirectional mechanical converter further includes switching means, which is used for switching the functioning directions of the first one-way clutch and the second one-way clutch.

Further, the switching means includes a switching shaft, a spiral groove arranged on the switching shaft and a push button, one end of which is arranged in the spiral groove.

Further, the speed increasing bidirectional mechanical converter further includes a holding means, which is used for keeping the planet carrier still.

Further, the holding means and the planet carrier are integrated or fixedly connected.

Further, the holding means is a holding ring.

Further, the main shaft rotates in the preset direction at an increased speed when a torque whose direction is opposite to the preset direction is applied to the first ring gear.

Further, the transmission ratio of the rotation of the main shaft in the preset direction at an increased speed is equal to the gear ratio between the first ring gear and the planet gear.

Further, the transmission ratio of rotation of the main shaft in the preset direction at an increased speed is 3.

Further, the main shaft rotates in the preset direction at a same speed when a torque whose direction is same with the preset direction is applied to the first ring gear.

Further, the transmission ratio of the rotation of the main shaft in the preset direction at a same speed is 1.

The present invention further discloses a wrench, including a torque outputting part, a speed increasing bidirectional mechanical converter, comprising a main shaft, which is coaxially arranged with the torque outputting part;

a speed increasing planet gear unit, which includes a first ring gear, a planet gear, a sun gear and a planet carrier, wherein the planet gear is mounted on the planet carrier, the planet gear is arranged between the first ring gear and the sun gear, and the first ring gear rotates in an opposite direction against the sun gear;

a handle, which is coaxially arranged with the first ring gear and used for inputting torque;

the speed increasing bidirectional mechanical converter further includes a reversing means, via which the first ring gear and the sun gear drive the main shaft;

when in use, the planet carrier is kept still, and the torque outputting part rotates in a preset direction no matter a clockwise or anticlockwise torque is applied to the first ring gear by the handle.

Further, the reversing means includes a first one-way clutch and a second one-way clutch whose functioning directions are same as the preset direction.

Further, the speed increasing bidirectional mechanical converter further includes a second ring gear which is coaxially arranged with the first ring gear and connected to the first one-way clutch.

Further, the first ring gear and the second ring gear are integrated or coaxially connected.

Further, the speed increasing bidirectional mechanical converter further includes a third ring gear which is coaxially arranged with the sun gear and connected to the second one-way clutch.

Further, the sun gear and the third ring gear are integrated or coaxially connected.

Further, the speed increasing bidirectional mechanical converter further includes switching means, which is used for switching the functioning directions of the first one-way clutch and the second one-way clutch.

Further, the switching means includes a switching shaft and a switching knob which is arranged on one end of the switching shaft.

Further, the wrench further includes an unlocking means, which includes the switching knob and a groove arranged on the main shaft.

Further, the speed increasing bidirectional mechanical converter further includes a holding means, which is used for keeping the planet carrier still.

Further, the holding means and the planet carrier are integrated or fixedly connected.

Further, the holding means is a holding ring.

Further, the main shaft rotates in the preset direction at an increased speed when a torque whose direction is opposite to the preset direction is applied to the first ring gear.

Further, the transmission ratio of the rotation of the main shaft in the preset direction at an increased speed is equal to the gear ratio between the first ring gear and the planet gear.

Further, the transmission ratio of rotation of the main shaft in the preset direction at an increased speed is 3.

Further, the main shaft rotates in the preset direction at a same speed when a torque whose direction is same with the preset direction is applied to the first ring gear.

Further, the transmission ratio of the rotation of the main shaft in the preset direction at a same speed is 1.

Compared with the prior arts, the speed increasing bidirectional mechanical converter provided in the present invention has beneficial effects as follows: the structure of the speed increasing bidirectional mechanical converter is simplified, the manufacture is facilitated, and the space it occupies in the tool and its weight are decreased as well, by using the speed increasing planet gear unit to realize the reverse of the directions.

The present invention will be described in detail hereinafter in combination with the figures and embodiments for better understanding the purpose, features and effects of the present invention.

DETAILED DESCRIPTION OF THE PREFERRED EMBODIMENTS

The clockwise direction and the anticlockwise direction are the clockwise direction and the anticlockwise direction seen from the handle to the rod of the screwdriver.

Figure 1:
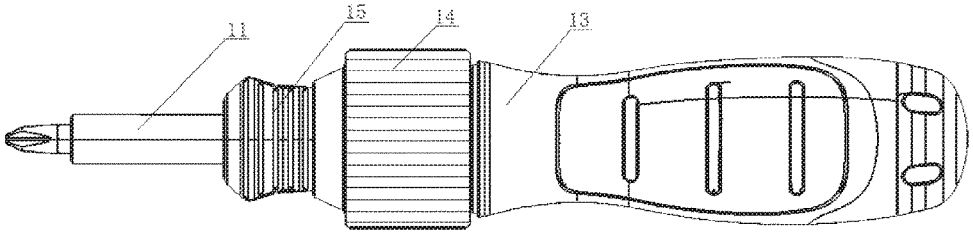
FIG. 1 is a front view of a screwdriver including the speed increasing bidirectional mechanical converter in one embodiment of the present invention.
Figure 2:
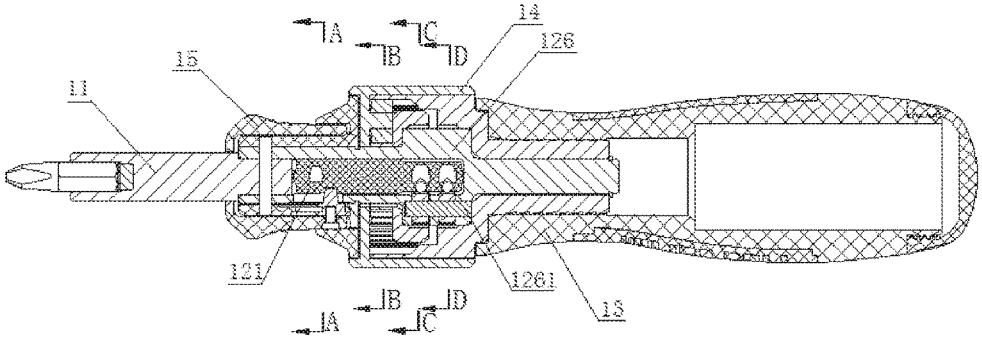
FIG. 2 is a sectional view of the screwdriver shown in FIG. 1.

FIG. 1 is a front view of a screwdriver including a speed increasing bidirectional mechanical converter in one embodiment of the present invention. FIG. 2 is a sectional view of the screwdriver shown in FIG. 1. As shown in FIGS. 1 and 2, the screwdriver including the speed increasing bidirectional mechanical converter in the embodiment includes: a rod 11, a button cover 15, a holding means and a handle 13. The screwdriver further includes a speed increasing bidirectional mechanical converter arranged in the holding means.

In the embodiment, the holding means is a holding ring 14, and the holding ring 14 is a cylindrical ring.

Figure 3:
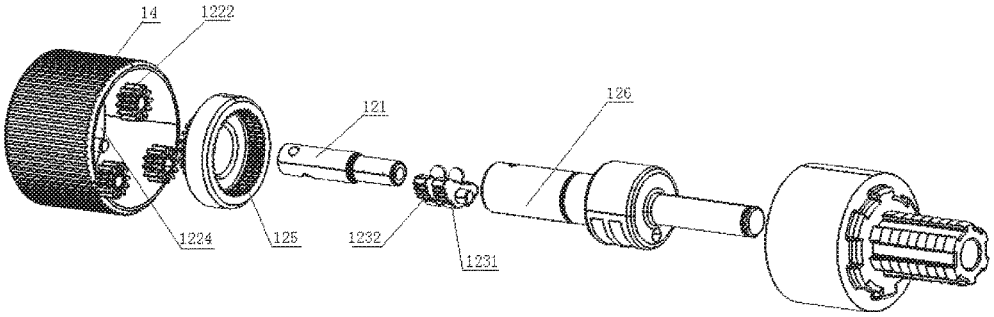
FIG. 3 is an exploded view of the speed increasing bidirectional mechanical converter of the screwdriver shown in FIG. 1.
Figure 4:
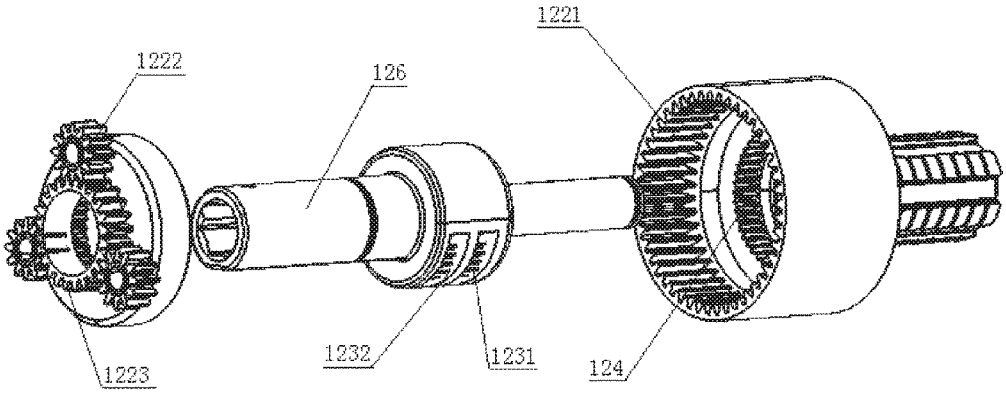
FIG. 4 shows the connectivity of the speed increasing bidirectional mechanical converter of the screwdriver shown in FIG. 1.
Figure 5:
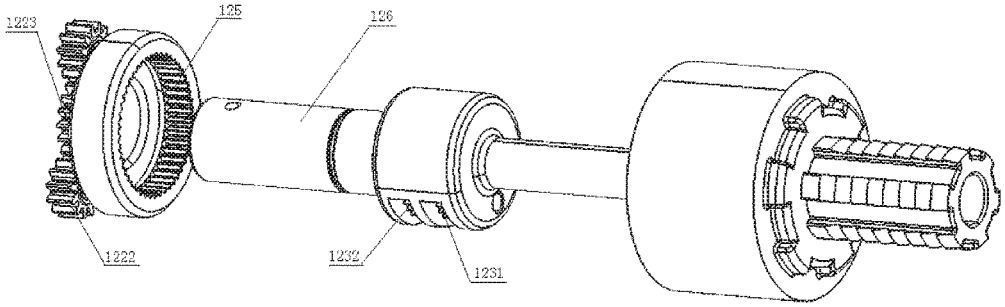
FIG. 5 shows the connectivity of the speed increasing bidirectional mechanical converter of the screwdriver shown in FIG. 1.

FIG. 3 is an exploded view of the speed increasing bidirectional mechanical converter of the screwdriver shown in FIG. 1. FIGS. 4 and 5 show the connectivity of the speed increasing bidirectional mechanical converter of the screwdriver shown in FIG. 1. As shown in FIGS. 3-5, the speed increasing bidirectional mechanical converter includes a main shaft 126, a speed increasing planet unit and a reversing means.

Figure 6:
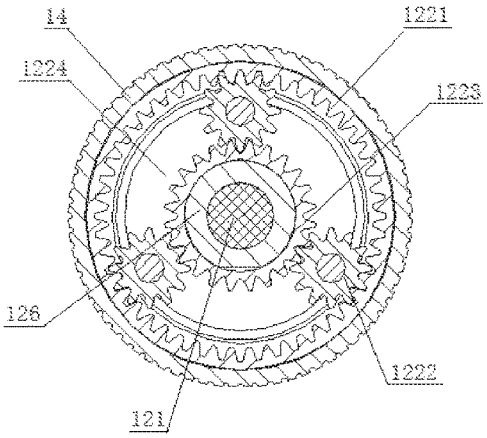
FIG. 6 is a sectional view along B-B of the screwdriver shown in FIG. 2.

The speed increasing planet gear unit includes a first ring gear 1221, a planet gear 1222, a sun gear 1223 and a planet carrier 1224, wherein the planet gear 1222 is mounted on the planet carrier 1224, the planet gear 1222 is arranged between the first ring gear 1221 and the sun gear 1223, and the first ring gear 1221 rotates in an opposite direction against the sun gear 1223, as shown in FIG. 6.

As shown in FIG. 3, the reversing means includes a first one-way clutch 1231 and a second one-way clutch 1232 with same functioning directions which are same with a preset direction, i.e. the direction the main shaft 126 rotates.

The speed increasing bidirectional mechanical converter in the embodiment utilizes the technical feature that in the speed increasing planet gear unit the first ring gear 1221 and the sun gear 1223 rotate in opposite directions, and makes the first ring gear 1221 and the sun gear 1223 to drive the main shaft 126 respectively via the first one-way clutch 1231 and the second one-way clutch 1232 with same functioning directions, thereby realizes the reverse of the directions. The main shaft 126 rotates in the preset direction no matter a clockwise or anticlockwise torque is applied to the first ring gear 1221.

The speed increasing bidirectional mechanical converter further includes a second ring gear 124 which is coaxially arranged with the first ring gear 1221 and connected to the first one-way clutch 1231. This enables the first ring gear 1221 to drive the main shaft 126 via the first one-way clutch 1231. In the embodiment, the first ring gear 1221 and the second ring gear 124 are integrated.

It also works that the first ring gear 1221 and the second ring gear 124 are non-integrated, but coaxially connected.

The speed increasing bidirectional mechanical converter further includes a third ring gear 125 which is coaxially arranged with the sun gear 1223 and connected to the second one-way clutch 1232. This enables the sun gear 1223 to drive the main shaft 126 via the second one-way clutch 1232. In the embodiment, the sun gear 1223 and the third ring gear 125 are integrated.

It also works that the sun gear 1223 and the third ring gear 125 are non-integrated, but coaxially connected.

Figure 7:
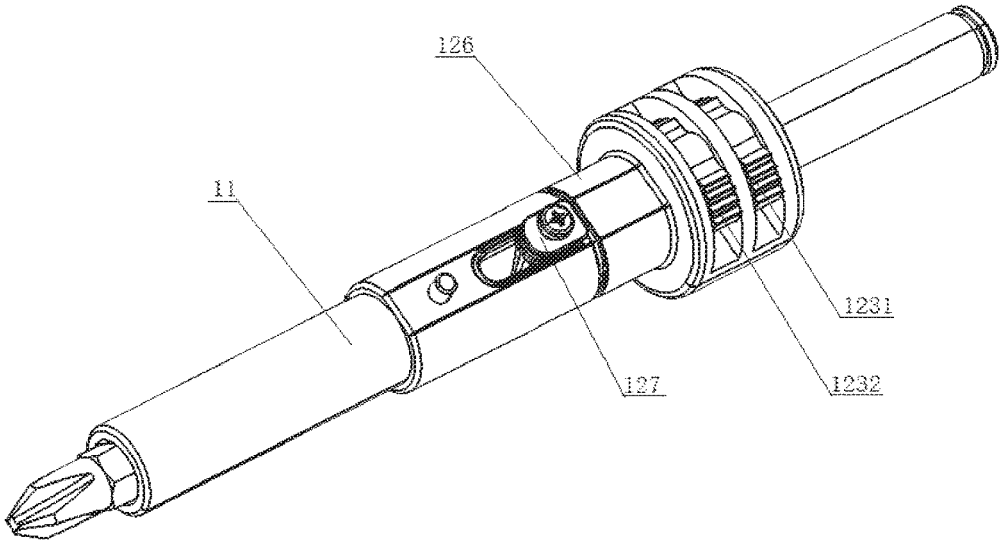
FIG. 7 is a perspective view of the main shaft of the speed increasing bidirectional mechanical converter of the screwdriver shown in FIG. 1.

FIG. 7 shows the connectivity between the main shaft 126 and each part.

The main shaft 126 is connected to the rod 11 via a pin, which enables the main shaft 126 and the rod 11 to be arranged coaxially. When the main shaft 126 rotates, it drives the rod 11 to rotate.

In the embodiment, the first one-way clutch 1231 and the second one-way clutch 1232 are pawls. While the first one-way clutch 1231 and the second one-way clutch 1232 can be structured otherwise.

Figure 8:
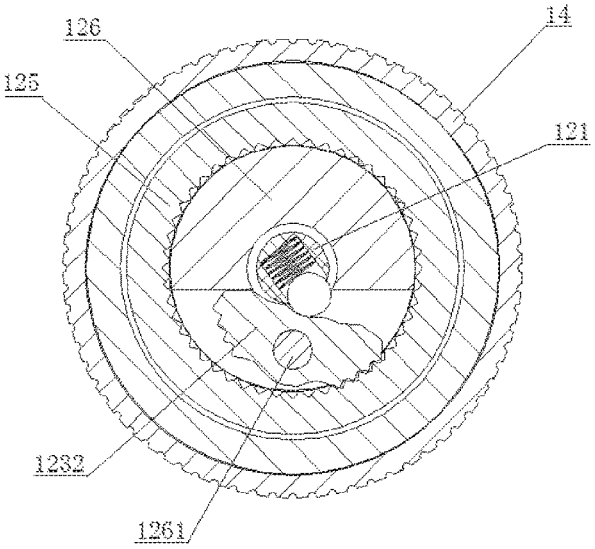
FIG. 8 is a sectional view along C-C of the screwdriver shown in FIG. 2.

As shown in FIG. 8, a blind hole is arranged in the switching shaft 121. A spring is arranged in the blind hole. A ball is arranged at the opening of the blind hole. The pawl 1232 has a curved surface at the side facing the switching shaft 121, which engages with the ball, forming a connection between the pawl 1232 and the switching shaft 121, enabling the rotation of the switching shaft 121 to drive the pawl 1232 to rotate.

The pawl 1232 is mounted on the main shaft 126 via a pin 1261. There are teeth on the two opposite sides of the pawl 1232. At the position shown in FIG. 7, the teeth on one side of the pawl 1232 engage with the third ring gear 125, and when the third ring gear 125 rotates clockwise, the main shaft 126 is driven to rotate clockwise because the sun gear 1223 and the third ring gear 125 are integrated. That is to say, the sun gear 1223 drives the main shaft 126 to rotate clockwise. When the third ring gear 125 rotates anticlockwise, the pawl 1232 disengages with the third ring gear 125, thus cannot drive the main shaft 126 to rotate. The third ring gear 125 idles relative to the main shaft 126. That is to say, the sun gear 1223 idles relative to the main shaft 126.

Figure 9:
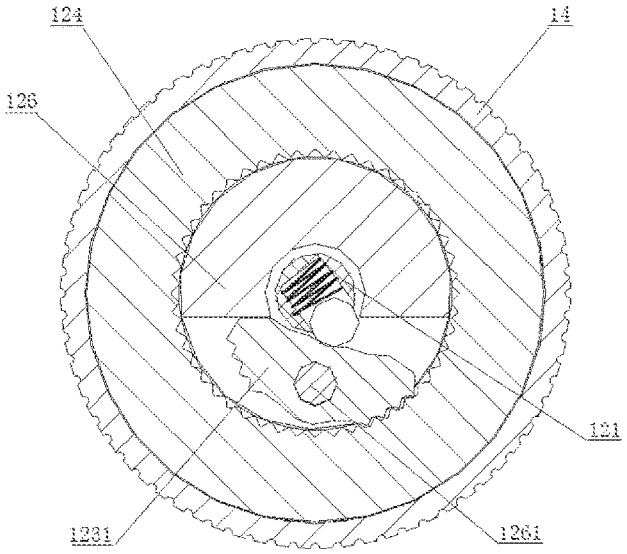
FIG. 9 is a sectional view along D-D of the screwdriver shown in FIG. 2.

As shown in FIG. 9, a blind hole is arranged in the switching shaft 121. A spring is arranged in the blind hold. A ball is arranged at the opening of the blind hole. The pawl 1231 has a curved surface at the side facing the switching shaft 121, which engages with the ball, forming a connection between the pawl 1231 and the switching shaft 121. The pawl 1231 is mounted on the main shaft 126 via the pin 1261. There are teeth on the two opposite sides of the pawl 1231. At the position shown in FIG. 8, the teeth on one side of the pawl 1231 engage with the second ring gear 124, and when the second ring gear 124 rotates clockwise, the main shaft 126 is driven to rotate clockwise because the first ring gear 1221 and the second ring gear 124 are integrated. That is to say, the first ring gear 1221 drives the main shaft 126 to rotate clockwise. When the second ring gear 124 rotates anticlockwise, the pawl 1231 disengages with the second ring gear 145, thus cannot drive the main shaft 126 to rotate. The second ring gear 124 idles relative to the main shaft 126. That is to say, the first ring gear 1221 idles relative to the main shaft 126.

At the position shown in FIGS. 8 and 9, the functioning directions of the pawls 1231 and 1232 are clockwise. That is to say, in the ring gears 124 and 125 which engage with the pawls 1231 and 1232, only the one rotates clockwise can drive the main shaft 126 to rotate clockwise. That is to say, the preset direction is same with the functioning directions of the pawls 1232 and 1232, which is clockwise.

Rotate the switching shaft 121 to change the teeth of the pawls 1231 and 1232 that engage with the main shaft 126, the rotating direction of the main shaft 126 can be reversed.

The handle 13, which is arranged coaxially with the first ring gear 1221, is used for inputting torque.

The holding ring 14 is used for keeping the planet carrier 1224 still.

In the embodiment, the holding ring 14 and the planet carrier 1224 are integrated.

It also works that the holding ring 14 and the planet carrier 1224 are non-integrated, but fixedly connected.

When use the screwdriver of the embodiment, hold the holding ring 14 to keep the planet carrier 1224 still, rotate the handle 13 clockwise to apply a clockwise torque to the first ring gear 1221, enabling the second ring gear 125 to rotate clockwise. As shown in FIG. 9, the second ring gear 125 drives the main shaft 126 to rotate clockwise, the first ring gear 1221 drives the sun gear 1223 to rotate anticlockwise via the planet gear 1222, enabling the third ring gear 124 to rotate anticlockwise. As shown in FIG. 8, the third ring gear 124 idles relative to the main shaft 126. That is to say, the sun gear 1223 idles relative to the main shaft 126.

In the screwdriver of the embodiment, the pawl 1231 and the first ring gear 1221 constitute a master ratchet, the pawl 1232 and the sun gear 1223 constitute an assistant ratchet. The planet gear 1222 is arranged between the sun gear 1223 and the second ring gear 125 which is integrated with the first ring gear. After reversing by the holding ring 14, the assistant ratchet that is reverse to the master ratchet is formed. When the master ratchet rotates anticlockwise and drives the rod 11 to rotate anticlockwise, the assistant ratchet idles because of the reversing. When the master ratchet rotates clockwise, the master ratchet idles while the assistant ratchet drives the rod 11 to rotate anticlockwise after being reversed via the holding ring 14. Thus it is realized that the rod 11 rotates in one direction no matter a clockwise or anticlockwise torque is applied to the first ring gear 1221 by rotating the handle 13, when the holding ring 14 is held to keep the planet carrier 1224 still.

The transmission ratio of the speed increasing planet gear unit is equal to the gear ratio between the first ring gear 1221 and the planet gear 1222. In the embodiment, the transmission ratio is 3. When the handle 13 rotates clockwise, the rod 11 which is coaxially arranged with the main shaft 126 rotates clockwise at the same speed. When the handle 13 rotates anticlockwise, the rod 11 which is coaxially arranged with the main shaft 126 rotates clockwise at triple the speed.

The speed increasing bidirectional mechanical converter in the embodiment further includes a switching means, which is used for switching the functioning directions of the first one-way clutch 1231 and the second one-way clutch 1232.

Figure 10:
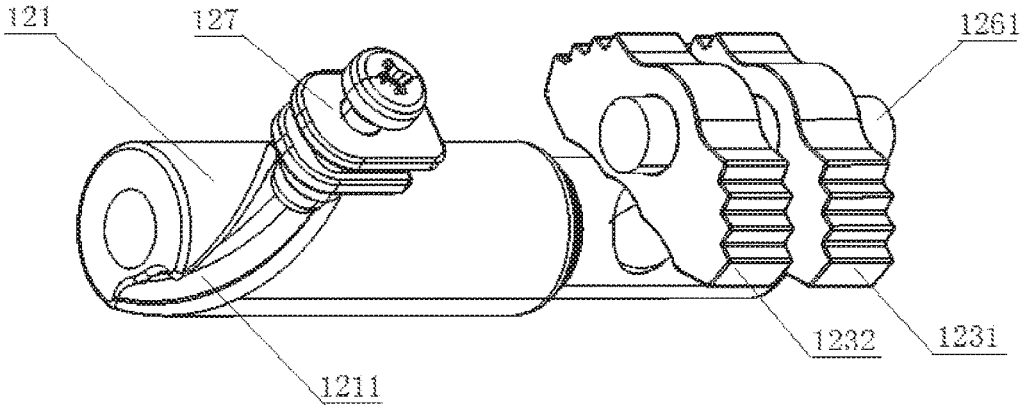
FIG. 10 is a schematic view of the switching means of the speed increasing bidirectional mechanical converter of the screwdriver shown in FIG. 1.

As shown in FIG. 10, the switching means includes a switching shaft 121, a spiral groove 1211 arranged on the switching shaft 121 and a push button 127 one end of which is arranged in the spiral groove 1211. As shown in FIG. 7, the push button 127 is arranged in a long hole of the main shaft 126. The button cover 15 is sheathed outside the main shaft 126. When the button cover 15 moves axially along the main shaft 126, it drives the push button 127 to move axially in the long hole of the main shaft 126 along the main shaft 126. The one end of the push button 127 moves along the spiral groove 1211 to enable the switching shaft 121 to rotate, to drive the first one-way clutch 1231 and the second one-way clutch 1232 to rotate relative to the pin 1261. Thus the functioning directions of the first one-way clutch 1231 and the second one-way clutch 1232 are reversed.

Figure 11:
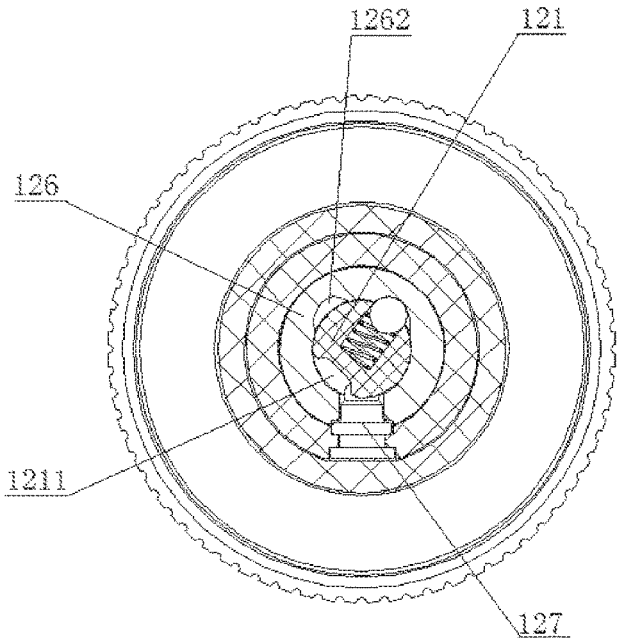
FIG. 11 is a sectional view along A-A of the screwdriver shown in FIG. 2.

As shown in FIG. 11, two curved concaves are arranged on the inner side of the main shaft 126. A blind hole is arranged to the switching shaft 121. A spring is arranged in the blind hole. A ball is arranged at the opening of the blind hole. After the rotation of the switching shaft 121, the ball engages in the curved concaves, to keep the functioning directions of the first one-way clutch 1231 and the second one-way clutch 1232 stable during the use of the screwdriver.

The screwdriver in the embodiment utilizes the technical feature that in the speed increasing planet gear unit the first ring gear 1221 and the sun gear 1223 rotates in opposite directions, and makes the first ring gear 1221 and the sun gear 1223 to drive the main shaft 126 respectively via the first one-way clutch 1231 and the second one-way clutch 1232 with same functioning directions, to realize the reverse of the directions. The rod 11 rotates in a preset direction no matter the handle 13 rotates clockwise or anticlockwise. When the handle 13 rotates in the same direction as the preset direction, the rod 11 and the handle 13 rotate in the preset direction at a same speed. When the handle 13 rotates in the opposite direction to the preset direction, the rod 11 rotates in the preset direction at triple the speed of the handle 13. The switching means is for reversing the preset direction.

Figure 12:
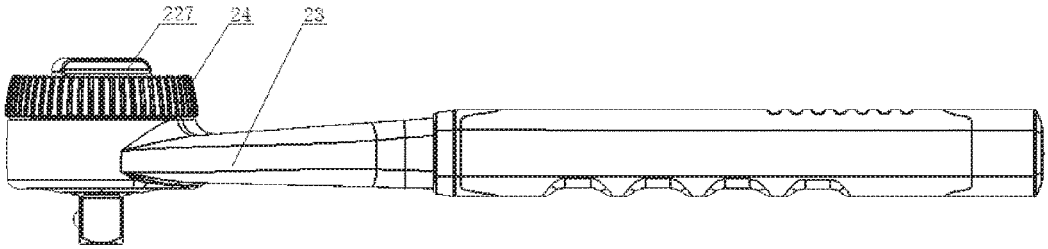
FIG. 12 is a front view of a wrench including the speed increasing bidirectional mechanical converter in another embodiment of the present invention.
Figure 13:
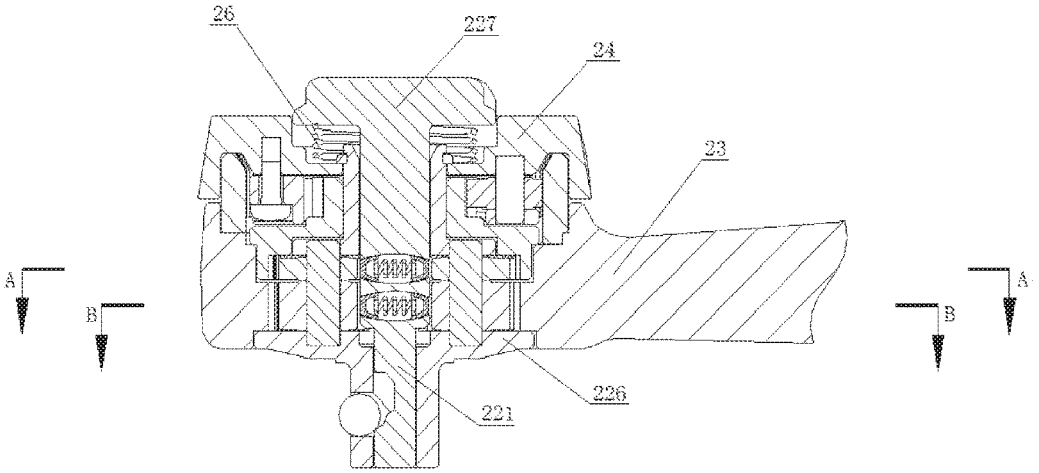
FIG. 13 is a part sectional view of the wrench shown in FIG. 12.

FIG. 12 is a front view of a wrench including a speed increasing bidirectional mechanical converter in another embodiment of the present invention. FIG. 13 is a part sectional view of the wrench shown in FIG. 12. As shown in FIGS. 12 and 13, the wrench including the speed increasing bidirectional mechanical converter in the embodiment includes: a switching knob 227, a holding means, a speed increasing bidirectional mechanical converter, a handle 23 and a torque outputting part 21, wherein the holding means is a holding ring 24 which is a conical ring.

Figure 14:
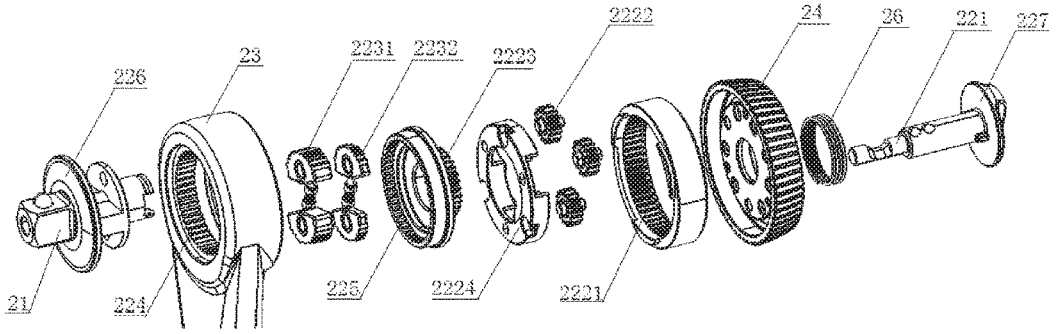
FIG. 14 is an exploded view of the wrench shown in FIG. 12.

As shown in FIG. 14, the speed increasing bidirectional mechanical converter includes a main shaft 226, a speed increasing planet gear unit and a reversing means, wherein the main shaft 226 and the torque outputting part 21 are arranged coaxially.

The speed increasing planet gear unit includes a first ring gear 2221, a planet gear 1222, a sun gear 2223 and a planet carrier 2224, wherein the planet gear 2222 is mounted on the planet carrier 2224, the planet gear 2222 is arranged between the first ring gear 2221 and the sun gear 2223, and the first ring gear 2221 rotates in an opposite direction against the sun gear 2223.

The reversing means includes a first one-way clutch 2231 and a second one-way clutch 2232 with same functioning directions. The functioning directions are same with a preset direction, i.e. the direction the main shaft 226 rotates in.

The speed increasing bidirectional mechanical converter in the embodiment utilizes the technical feature that in the speed increasing planet gear unit the first ring gear 2221 and the sun gear 2223 rotate in opposite directions, and makes the first ring gear 2221 and the sun gear 2223 to drive the main shaft 226 respectively via the first one-way clutch 2231 and the second one-way clutch 2232 with same functioning directions, to realize the reverse of the directions. The main shaft 226 rotates in the preset direction no matter a clockwise or anticlockwise torque is applied to the first ring gear 2221.

The speed increasing bidirectional mechanical converter further includes a second ring gear 224 which is coaxially arranged with the first ring gear 2221 and connected to the first one-way clutch 2231. This enables the first ring gear 2221 to drive the main shaft 226 via the first one-way clutch 2231. In the embodiment, the first ring gear 2221 and the second ring gear 224 are non-integrated and connected coaxially.

The speed increasing bidirectional mechanical converter further includes a third ring gear 225 which is coaxially arranged with the sun gear 2223 and connected to the second one-way clutch 2232. This enables the sun gear 2223 to drive the main shaft 226 via the second one-way clutch 2232. In the embodiment, the sun gear 1223 and the third ring gear 125 are integrated.

The main shaft 226 is fixedly connected to the torque outputting part 21. When the main shaft 226 rotates, it drives the torque outputting part 21 to rotate.

In the embodiment, the first one-way clutch 2231 and the second one-way clutch 2232 are pawls.

Figure 15:
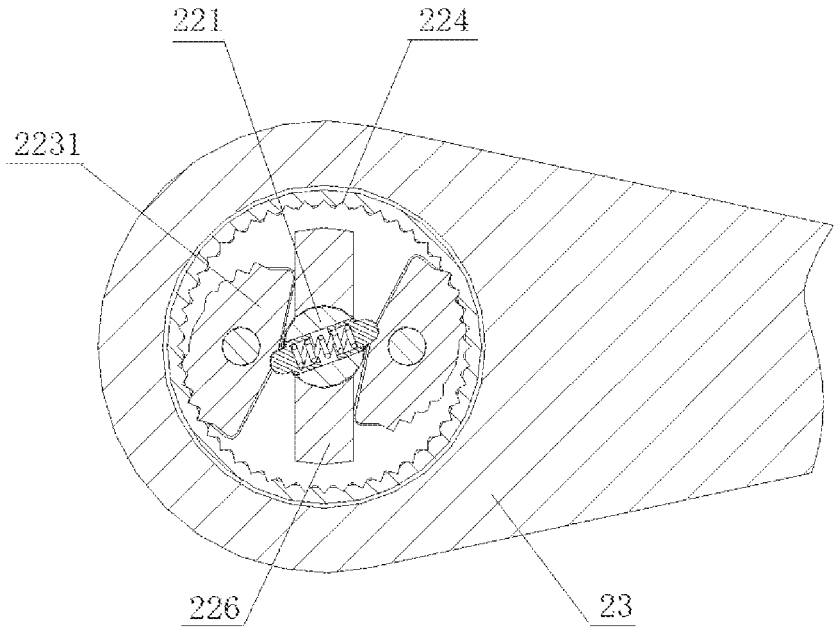
FIG. 15 is a sectional view along A-A of the wrench shown in FIG. 13.

As shown in FIG. 15, the first one-way clutch 2231 includes a pair of pawls. Curved surface is arranged on the pawl's side facing the switching shaft 221. A through hole is arranged in the switching shaft 221. A spring is arranged in the through hole. Two ball plungers are arranged at the two openings of the through hole respectively and engaged to the curved surface on the pawls, forming the connection between the first one-way clutch 2231 and the switching shaft 221.

The first one-way clutch 2231 is mounted on the main shaft 226 via a pin. There are teeth on the two opposite sides of the first one-way clutch 2231. At the position shown in FIG. 15, the teeth on one side of the first one-way clutch 2231 engage with the second ring gear 224, and when the second ring gear 224 rotates clockwise, the main shaft 226 is driven to rotate clockwise because the first ring gear 2221 and the second ring gear 224 are connected coaxially. That is to say, the first ring gear 2221 drives the main shaft 226 to rotate clockwise. When the second ring gear 224 rotates anticlockwise, the first one-way clutch 2231 disengages with second ring gear 224, thus cannot drive the main shaft 226 to rotate. The second ring gear 224 idles relative to the main shaft 226. That is to say, the first ring gear 2221 idles relative to the main shaft 226.

Figure 16:
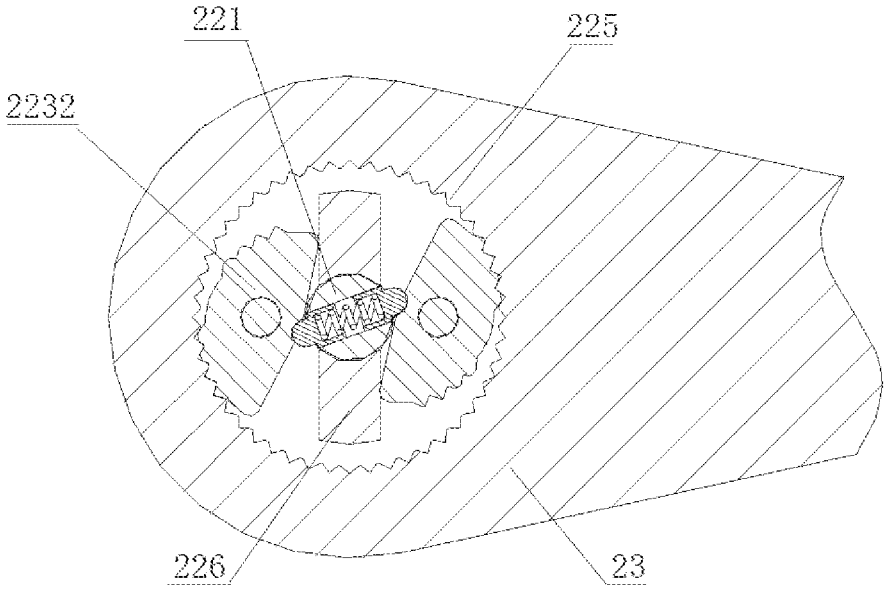
FIG. 16 is a sectional view along B-B of the wrench shown in FIG. 13.

As shown in FIG. 16, the second one-way clutch 2232 includes a pair of pawls. Curved surface is arranged on the pawl's side facing the switching shaft 221. A through hole is arranged in the switching shaft 221. A spring is arranged in the through hole. Two ball plungers are arranged at the two openings of the through hole respectively and engaged to the curved surface on the pawls, forming the connection between the second one-way clutch 2232 and the switching shaft 221.

The second one-way clutch 2232 is mounted on the main shaft 226 via a pin. There are teeth on the two opposite sides of the second one-way clutch 2232. At the position shown in FIG. 16, the teeth on one side of the second one-way clutch 2232 engage with the third ring gear 225, and when the third ring gear 225 rotates clockwise, the main shaft 226 is driven to rotate clockwise because the sun gear 2223 and the third ring gear 225 are integrated. That is to say, the sun gear 2223 drives the main shaft 226 to rotate clockwise. When the third ring gear 225 rotates anticlockwise, the second one-way clutch 2232 disengages with third ring gear 225, thus cannot drive the main shaft 226 to rotate. The third ring gear 225 idles relative to the main shaft 226. That is to say, the sun gear 2223 idles relative to the main shaft 226.

At the position shown in FIGS. 15 and 16, the functioning directions of the one-way clutches 2231 and 2232 are clockwise. That is to say, in the ring gears 224 and 225 which engage with the one-way clutches 2231 and 2232, only the one rotates clockwise can drive the main shaft 226 to rotate clockwise. That is to say, the preset direction is same with the functioning directions of the one-way clutches 2232 and 2232, which is clockwise.

The handle 13 is used for inputting torque.

Figure 17:
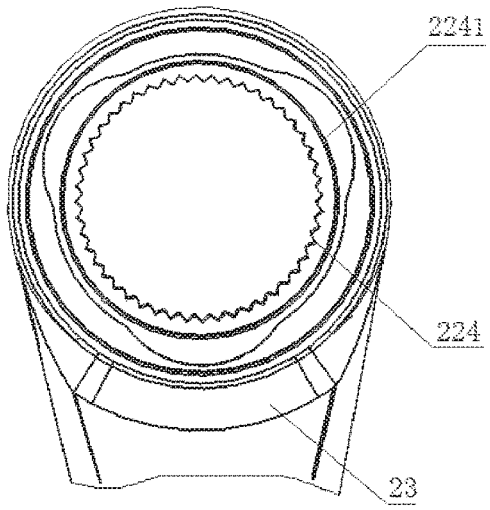
FIG. 17 is a front view of the handle of the wrench shown in FIG. 12.

As shown in FIG. 17, the second ring gear 224 is arranged in the handle 23 and they are integrated. Three curved concave parts are arranged along the circular inner side of the second ring gear 224 which is facing the first ring gear 2221. As shown in FIG. 14, the three curved concave parts are engaged with the three convex parts on the side of the first ring gear 2221 which is facing the second ring gear 224, forming the coaxial connection between the second ring gear 224 and the first ring gear 2221.

Other coaxial connection between the second ring gear 224 and the first ring gear 2221 can be adopted, which is not limited by the present invention.

The holding ring 24 is used for keeping the planet carrier 2224 still.

In the embodiment, the holding ring 24 and the planet carrier 2224 are non-integrated and fixedly connected.

When use the wrench of the embodiment, hold the holding ring 24 to keep the planet carrier 2224 still, rotate the handle 23 clockwise to apply a clockwise torque to the second ring gear 225, enabling the first ring gear 2221 rotates clockwise. As shown in FIG. 16, the second ring gear 225 drives the main shaft 226 to rotate clockwise, the first ring gear 2221 drives the sun gear 2223 to rotate anticlockwise via the planet gear 2222, enabling the third ring gear 224 to rotate anticlockwise. As shown in FIG. 15, the third ring gear 224 idles relative to the main shaft 226. That is to say, the sun gear 2223 idles relative to the main shaft 126.

When use the wrench of the embodiment, hold the holding ring 24 to keep the planet carrier 2224 still, rotate the handle 23 anticlockwise to apply an anticlockwise torque to the second ring gear 225, enabling the first ring gear 2221 rotates anticlockwise. As shown in FIG. 16, the second ring gear 225 idles relative to the main shaft 126, the first ring gear 2221 drives the sun gear 2223 to rotate clockwise at an increased speed via the planet gear 2222, enabling the third ring gear 224 to rotate clockwise. As shown in FIG. 15, the third ring gear 224 drives the main shaft 226 to rotate clockwise. That is to say, the sun gear 2223 drives the main shaft 126 to rotate clockwise.

The transmission ratio of the speed increasing planet gear unit is equal to the gear ratio between the first ring gear 2221 and the planet gear 2222. In the embodiment, the transmission ratio is 3. When the handle 23 rotates clockwise, the torque outputting part 21 which is coaxially arranged with the main shaft 226 rotates clockwise at the same speed. When the handle 23 rotates anticlockwise, the torque outputting part 21 which is coaxially arranged with the main shaft 226 rotates clockwise at triple the speed.

The speed increasing bidirectional mechanical converter in the embodiment further includes a switching means, which is used for switching the functioning directions of the first one-way clutch 2231 and the second one-way clutch 2232.

The switching means includes a switching shaft 221 and a switching knob 227 arranged on the switching shaft 221. Rotate the switching knob 227, the switching shaft 221 is driven to rotate, driving the first one-way clutch 2231 and the second one-way clutch 2232 to rotate relative to the pin. Thus the functioning directions of the first one-way clutch 2231 and the second one-way clutch 2232 are reversed.

Figure 18:
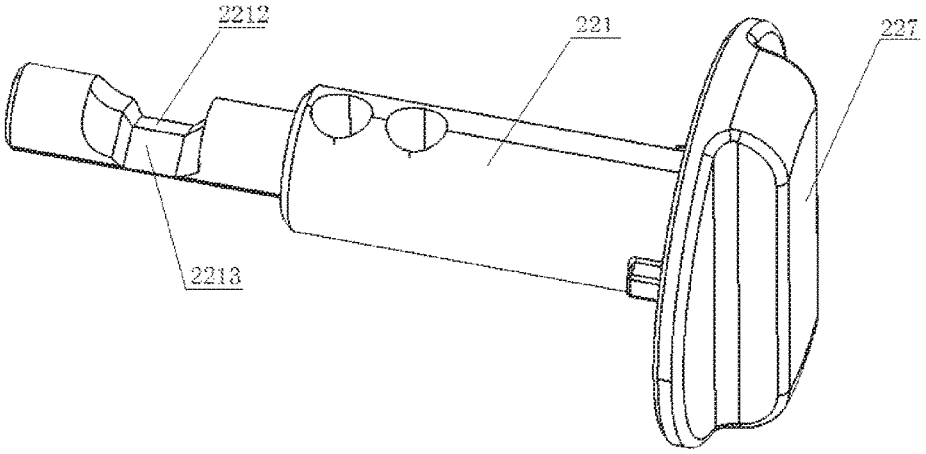
FIG. 18 is a schematic view of the switching means of the speed increasing bidirectional mechanical converter of the wrench shown in FIG. 12.
Figure 19:
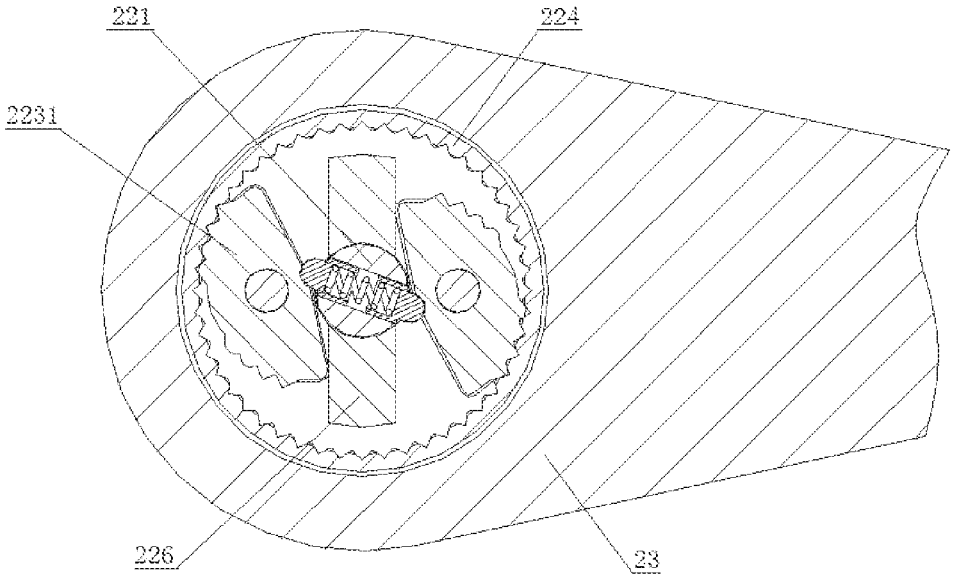
FIG. 19 is a sectional view along A-A of the wrench shown in FIG. 13.

The wrench in the embodiment further includes an unlocking means, which includes a ball arranged on the torque outputting part 21, the switching knob 227, a spring 26, and a first groove 2212 and a second groove 2213 which are arranged in the switching shaft 221. As shown in FIG. 18, the first groove 2212 and the second groove 2213 have different depths. The ends of the first groove 2212 and the second groove 2213 which are closer to the switching knob 227 have deeper depths.

When the switching knob 227 is pushed down, the ball enters the deeper part of the first groove 2212 or the second groove 2213 and the unlocking is achieved. When the switching knob 227 is released, the elastic force provided by the sheathed spring 26 restores the switching knob 227 to its original position and enable the ball to move to the shallower part and bounce up.

The wrench in the embodiment utilizes the technical feature that in the speed increasing planet gear unit the first ring gear 2221 and the sun gear 2223 rotates in opposite directions, and makes the first ring gear 2221 and the sun gear 2223 to drive the main shaft 226 respectively via the one-way clutches 1231 and 1232 with same functioning directions, to realize the reverse of the directions. The torque outputting part 21 rotates in the preset direction no matter the handle 23 rotates clockwise or anticlockwise. When the handle 23 rotates in the same direction as the preset direction, the torque outputting part 21 and the handle 23 rotate in the preset direction at a same speed. When the handle 23 rotates in the opposite direction to the preset direction, the torque outputting part 21 rotates in the preset direction at triple the speed of the handle 23. The switching means is for reversing the preset direction.

What illustrated above are preferred embodiments of the present invention. It should be understood that persons skilled in the art can make many modifications and changed in accordance with the concept of the invention without creative work. So any technical solutions obtained through logical analyzing, reasoning or limited experiments in accordance with the concept of the present invention by the persons skilled in the art shall fall within the scope of the claims.

The invention claimed is:

1. A screwdriver, comprising:

a rod;

a speed increasing bidirectional mechanical converter, comprising:

a main shaft, which is coaxially arranged with the rod;

a speed increasing planet gear unit, which includes a first ring gear, a planet gear, a sun gear and a planet carrier, wherein the planet gear is mounted on the planet carrier, the planet gear is arranged between the first ring gear and the sun gear, and the first ring gear rotates in an opposite direction against the sun gear;

a handle, which is coaxially arranged with the first ring gear and used for inputting torque;

wherein the speed increasing bidirectional mechanical converter further includes a reversing means, including a first one-way clutch and a second one-way clutch with same functioning directions, via which the first ring gear and the sun gear drive the main shaft;

when in use, the planet carrier is kept still, and the rod rotates in a preset direction no matter a clockwise or anticlockwise torque is applied to the first ring gear by the handle;

wherein the speed increasing bidirectional mechanical converter further includes a second ring gear which is coaxially arranged with the first ring gear and connected to the first one-way clutch wherein the first ring gear and the second ring gear are fixed relative to one another for fixed rotation together; and wherein the speed increasing bidirectional mechanical converter further includes a third ring gear which is engaged with the second one-way clutch, coaxially arranged with the sun gear and fixed relative to the sun gear for fixed rotation therewith.

2. The screwdriver according to claim 1, wherein the functioning directions of the first one-way clutch and the second one-way clutch are the same as the preset direction.

3. The screwdriver according to claim 1, wherein the speed increasing bidirectional mechanical converter further includes a switching means, which is used for switching the functioning directions of the first one-way clutch and the second one-way clutch.

4. The screwdriver according to claim 3, wherein the switching means includes a switching shaft, a spiral groove arranged on the switching shaft, and a push button one end of which is arranged in the spiral groove.

5. The screwdriver according to claim 1, wherein the speed increasing bidirectional mechanical converter further includes a holding means, which is used for keeping the planet carrier still.

6. The screwdriver according to claim 5, wherein the holding means and the planet carrier are integrated or fixedly connected.

7. The screwdriver according to claim 5, wherein the holding means is a holding ring.

8. The screwdriver according to claim 1, wherein the main shaft rotates in the preset direction at an increased speed when a torque whose direction is opposite to the preset direction is applied to the first ring gear.

9. The screwdriver according to claim 8, wherein the transmission ratio of the rotation of the main shaft in the preset direction at the increased speed is equal to the gear ratio between the first ring gear and the planet gear.

10. The screwdriver according to claim 9, wherein the transmission ratio of the rotation of the main shaft in the preset direction at the increased speed is 3.

11. The screwdriver according to claim 1, wherein the main shaft rotates in the preset direction at a same speed when a torque whose direction is same with the preset direction is applied to the first ring gear.

* * * * *